US005123929A

United States Patent [19]

Allen

[11] Patent Number: 5,123,929

[45] Date of Patent: Jun. 23, 1992

[54] SPECIALIZED POOL CUE COVERING

[76] Inventor: Kenneth W. Allen, 1575 Melrose Ave., Chula Vista, Calif. 92011

[21] Appl. No.: 440,876

[22] Filed: Nov. 24, 1989

[51] Int. Cl.[5] ..... C14C 1/00

[52] U.S. Cl. ..... 8/94.12; 273/68; 8/94.1 R; 8/94.15

[58] Field of Search ..... 8/94.12, 94.1, 94.15; 273/68

[56] References Cited

U.S. PATENT DOCUMENTS 983,791 2/1911 Whipple ..... 8/94.12

FOREIGN PATENT DOCUMENTS 7122692 2/1973 France .

*Primary Examiner*—Prince Willis, Jr.
*Assistant Examiner*—John F. McNally

[57] ABSTRACT

A pool cue with a seamless snakeskin-covered shank is provided, together with a method for removing the skin from the snake, treating the skin, and curing it, and engaging it over the shank of a pool cue or any other elongated, rod-like core, and then shrinking it down around the core and coating it with a hard preservative surface.

9 Claims, 1 Drawing Sheet

SPECIALIZED POOL CUE COVERING

BACKGROUND OF THE INVENTION

Snakeskins, lizard skins, alligator skins, and other reptile skins, have been popular for many years as a fabric, or fabric coating, for boots, shoes, wallets, luggage, and many other types of consumer items. When making these items, the skin is cut appropriately before or after it is applied to the object, and bonded with some type of adhesive. In all instances, however, the skin is cut in some fashion, and some type of adhesive or cement is required to make the skin bond to the underlying substrate.

Because the skin is always cut, there is always a need for some type of adhesive to bond it to the substrate. Although high-quality adhesives are available to achieve this purpose, nonetheless, the presence of the adhesive affects to a certain extent both the color and possibly even the texture of the skin, at least in the case of a snakeskin, which is rather thin and almost transparent.

In an ideal situation, the skin would bond to the substrate without any adhesive, which could be made possible by using an un-slit seamless snakeskin when it is inserted over an elongated object such as the shank of a pool cue.

SUMMARY OF THE INVENTION

The instant invention is exactly as stated above, a seamless snakeskin-covered pool cue and a method for treating and applying the snakeskin to the shank of the pool cue so that it bonds seamlessly with no adhesive. Although a pool cue is described, the method is broad enough that any elongated object, or for that matter, any object that is basically cylindrical or conical, and is not longer than the skin of a snake, could be covered.

The method involves, first, removing the skin intact, by peeling it back from the snake, then cleaning it, and putting it through curing processes before it is slipped over the pool cue shank and caused to shrink down and tightly grip the shank so that no adhesive is required.

DETAILED DESCRIPTION OF THE PREFERRED EMBODIMENT

Although any snakeskin could be used for this purpose, those used to date have been rattlesnakes. Rattlesnakes are an appropriate size, and they seem to be one species that even environmentalists do not particularly miss.

Figure 1:
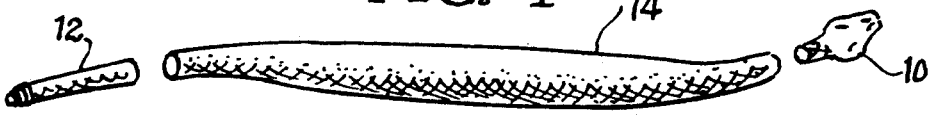
FIG. 1 illustrates a rattlesnake with its head and tail removed.

After catching the snake, which clearly requires certain skills and techniques in itself, the head 10 of the snake is cut off as shown in FIG. 1, and the tail 12 is cut off just above the anus, and discarded. This leaves the body 14 of the snake.

Figure 2:
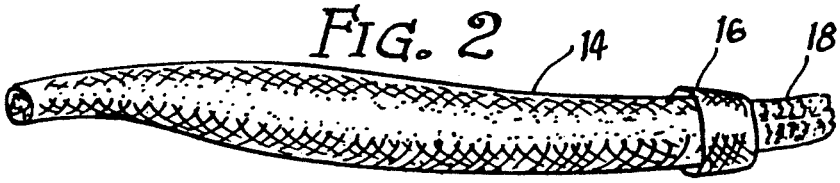
FIG. 2 illustrates the body portion of the snake with the skin being peeled back.
Figure 3:
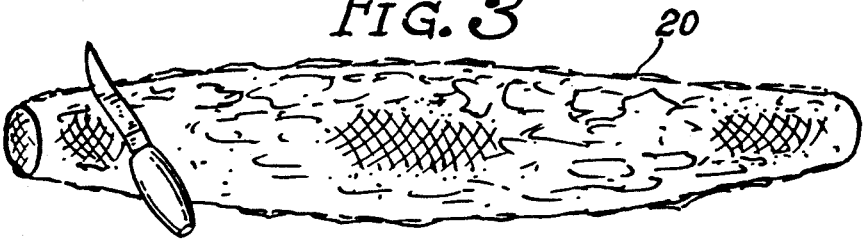
FIG. 3 illustrates the skin, inside-out, being scraped to remove most of the meat which is still clinging to the skin.

To most easily remove the snakeskin, it must be wet. Now, with only the body remaining, the skin 16 is pulled back from the meat 18, preferably beginning at the neck end of the snake, as shown in FIG. 2. As this is done, the skin 16 turns inside out, and when it is completely removed from the snake as shown in FIG. 3, it still has a certain amount of residual flesh 20 clinging to the skin which must be scraped off very gently so that clinging flesh is removed without damaging the skin.

Figure 4:
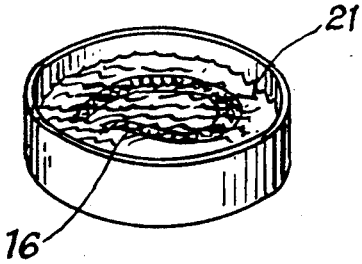
FIG. 4 illustrates the first curing process of soaking the skin in a concentrated saline solution.

Once the bulk of the clinging flesh has been scraped from the skin, the curing process begins. The first part of the curing process involves immersing the snakeskin in a highly concentrated saline solution, indicated at 21 in FIG. 4 for about three days. After three days, the skin is thoroughly washed off, and again, any meat still clinging to the skin is scraped off. At this point, the snakeskin is still inside-out.

The second part of the curing process is accomplished by first turning the skin right side-out. Once it is right side-out, there may be a layer of skin that has been shed, much like the shed skin that is produced naturally when the snake molts. This shed skin is removed, leaving the tougher and more colorful skin that would have remained with the snake after the molting.

Figure 5:
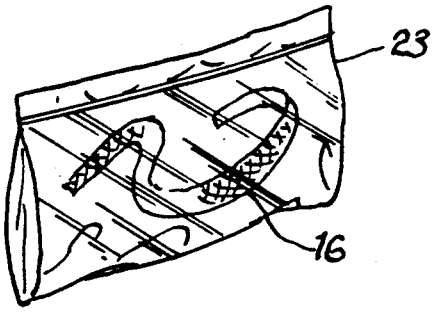
FIG. 5 illustrates the second portion of the curing process in which the skin is covered with an alcohol/-glycerin solution and is held for three days in a plastic bag.

The skin is then thoroughly washed, and undergoes the second part of the curing process which involves coating the skin, on the exterior side, with a mixture of glycerin and rubbing alcohol. According to the technique used currently, the ratio of glycerin to alcohol is 50/50. Once thoroughly coated with the mixture, the skin is placed inside a plastic bag such as Ziplock (tm) bag 23 in FIG. 5, and left for three days to cure. At the end of the third day, the skin is removed from the bag, is thoroughly washed, and it is ready to be mounted on the shank of the pool cue.

Again, it should be emphasized that whereas only the shank 26 of a pool cue 28 is discussed in the description herein, and illustrated and claimed, clearly the technique could be used to mount a skin on the entire length of the cue, or on any pole-like article, or even a much shorter article, for that matter.

Figure 6:
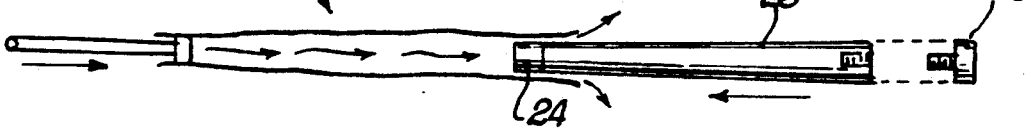
FIG. 6 illustrates the method for most effectively getting the skin onto the pool cue shank.
Figure 7:
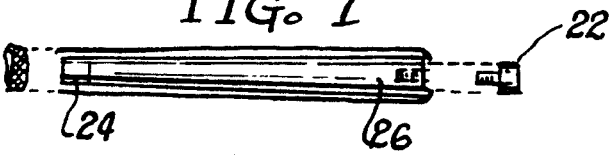
FIG. 7 illustrates the trimming of the skin around the shank.
Figure 8:
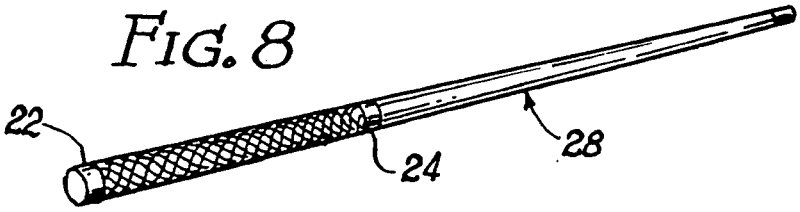
FIG. 8 illustrates the finished pool cue.

To best engage the skin on the pool cue shank 26, a light stream of water is forced through one end of the skin, preferably the smaller, neck end, as shown in FIG. 6. Then the narrower end of the shank of the pool cue is inserted in the other end. The water stream surrounding the pool cue lubricates the skin and provides a laminar flow around the shank to make it relatively easy to slip the skin all the way over the shank, until some excess of skin extends from both ends of the shank. Preferably, about an inch overhangs at each end.

Once the skin is in place, the air bubbles are removed by manually sliding the hand from one end to the other in a squeegee motion. At the same time, the skin is aligned so that its markings are linear, rather than being irregular as they would be otherwise. In other words, so that the end result is a covering in which the markings occur as they would on the snake, rather than being twisted.

Once this is done, the skin is ready to dry. The preferred technique, at least in the West, is to put the shank in the sun for a day. In the beginning, the skin must be checked about every five minutes for wrinkles, air bubbles, and skin alignment. As necessary, the snakeskin is again smoothed with the hand to straighten the markings and remove wrinkles and bubbles.

After being in the sun, the skin is shrunk down tightly around the shank of the cue stick. At this point, the ends can be trimmed with a razor blade, so that at the end of the cue stick, the skin overlaps somewhat so that it will be captured under the end cap 22 of the cue stick. At the center of the cue stick, which is the other end of the shank, the skin is trimmed so that it comes right to the edge of ferrule 24, at least in a two-part cue, in which the parts are unscrewed for transport.

At this point, the skin is securely engaged around the shank of the pool cue and it is cut to size at its ends. It is now sprayed with three or four coats of clear Polyurethane (tm), with the ferrule masked. Once the Polyurethane (tm) dries, the cap 22 is re-mounted and the cue is ready.

The snakeskin covering of the pool cue, with the Polyurethane (tm) coating, is reasonably tough, smooth, and is very attractive. If the pool cue has been sanded slightly, and covered with a light-colored coating of paint, such as an off-white, the coloring of the snakeskin is brought out and looks extremely attractive. The coloring of the skin in the final embodiment is thus not dictated by the color of an adhesive, but rather by whatever color works at looks best. Having no seam, not only is there no need to specially bond the seam so that it does not unravel, but a much more attractive covering is provided as well.

I claim:

1. A method of covering an elongate member with a seamless snakeskin comprising the following steps:

(a) removing the head and tail of the snake;

(b) peeling the skin from the body of the snake from one end to make said skin into an inside-out condition;

(c) removing any residual flesh;

(d) immersing said skin maintained in the inside-out condition in a concentrated saline solution for about three days;

(e) rinsing said skin;

(f) turning said skin into an outside-out condition;

(g) rinsing said skin;

(h) coating the skin with a solution of glycerine and alcohol;

(i) pulling said treated skin while still wet over the elongated member; and, (j) drying said skin on said elongated member to shrink said skin on said elongated member to shrink said skin around said elongated member.

2. A method according to claim 1 wherein said solution of glycerin and alcohol of step (h) is left on said skin for a period of about three days.

3. A method according to claim 1 wherein step (i) comprises forcing a stream of water through one end of said snakeskin and pulling said snakeskin over the elongated member through the other end.

4. A method according to claim 1 and including the step of coating said elongated member with a light-colored paint.

5. A method according to claim 1 including the step of manually smoothing the snakeskin to remove the air bubbles, wrinkles and to straighten the skin during step (i).

6. A method according to claim 1 wherein step (j) comprises exposing said skin to sunlight.

7. A method according to claim 1 comprising trimming the ends of the snakeskin to appropriately align with the proper points on the elongated member after step (F).

8. A method according to claim 7 and comprising coating said snakeskin with a clear protective coating.

9. A method according to claim 8 wherein said coating is a polyurethane coating.

* * * * *